United States Patent [19]

Reuter

[11] 4,407,427

[45] Oct. 4, 1983

[54] INTEGRAL HINGE COVERS FOR WASTE CONTAINER

[76] Inventor: Edward J. Reuter, 5215 Howard's Point Rd., Excelsior, Minn. 55331

[21] Appl. No.: 373,689

[22] Filed: Apr. 30, 1982

[51] Int. Cl.[3] ..... B65D 43/14; B65D 51/04

[52] U.S. Cl. ..... 220/339; 220/350; 220/1 T

[58] Field of Search ..... 220/1 T, 339, 350

[56] References Cited

U.S. PATENT DOCUMENTS

| | | | |
|---|---|---|---|
| 3,417,897 | 12/1968 | Johnson | 220/339 |
| 3,629,901 | 12/1971 | Wolf | 220/339 |
| 3,782,583 | 1/1974 | Alley | 220/339 |
| 4,213,539 | 7/1980 | Reuter | 220/1 T |

*Primary Examiner*—George T. Hall

*Attorney, Agent, or Firm*—Merchant, Gould, Smith, Edell, Welter and Schmidt

[57] ABSTRACT

A homogeneous, one piece container cover of stiff but flexible material including two or more cover portions interconnected by integral hinges. The hinges include parallel ridge and groove portions extending across the cover but terminating short of the periphery thereof, and nonridged, preferably generally flat hinge portions extending from the ridges to the periphery of the cover. One portion of the cover is adapted to be attached to a flange around the opening of a container, and the other portion or portions can be opened by flexing the hinge portions. The ridge and groove portions preferably terminate in smooth round or cone type sections, and thickening of one or more of the vertices of ridges and grooves is disclosed to prevent tearing or separation. An insert of stiffer material is configured to conform closely to the shape of a section and is attached thereto to increase the stiffness of a section of the cover, which may span a considerable distance in the case of large containers.

11 Claims, 11 Drawing Figures

FIG. 10
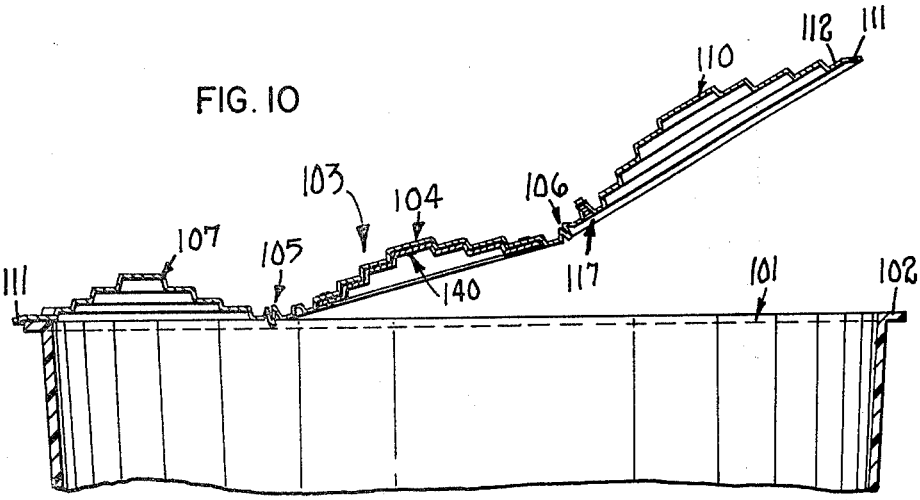
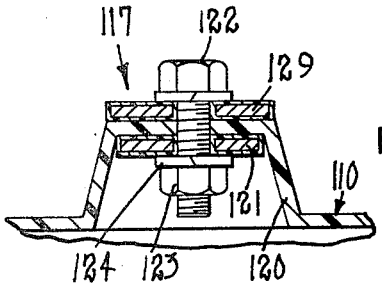
FIG. 9
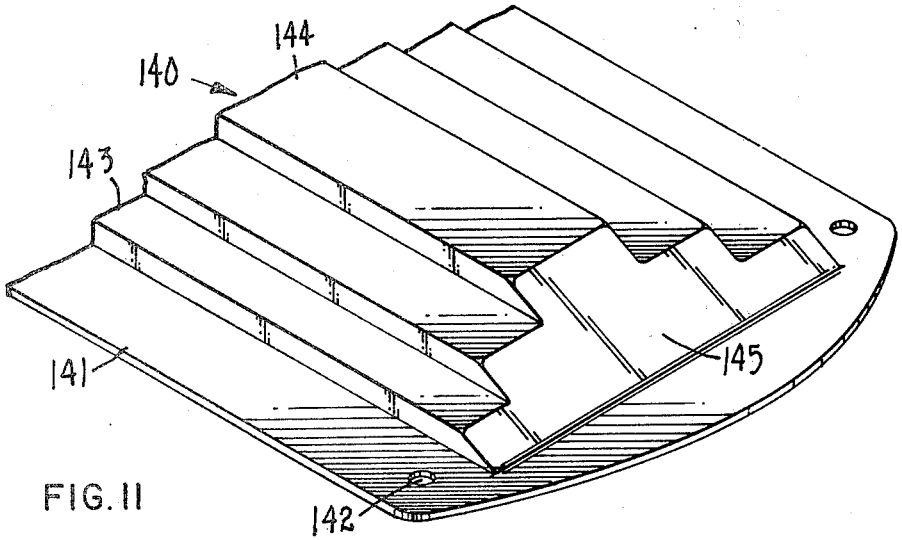
FIG. 11

INTEGRAL HINGE COVERS FOR WASTE CONTAINER

TECHNICAL FIELD OF THE INVENTION

This invention relates the field of containers, for example, the type of large containers used for the collection of waste in municipalities and large commercial establishments. In particular, the invention relates to improved covers for such waste containers.

BACKGROUND OF THE INVENTION

Large waste collection containers are generally located at specific sites which are visited periodically by vehicles into which the collected waste is transferred, often mechanically, from the containers, for removal from the site and disposition. The containers must be covered, to prevent them from filling with rain water or snow, and to minimize the attraction of insects. The covers should not be entirely removable from the containers, which would create a possibility of separation and loss, but yet the covers should be capable of easy opening to minimize interference with the depositing of waste into the containers or the later removal of waste from the containers.

One type of covered container meeting these objections is disclosed in my earlier U.S. Pat. No. 4,213,539, which discloses a hinge cover secured to a flange surrounding the top of the container. Hinges including moldings for receiving hinge pins are provided for convenient opening of the container, and means are provided to prevent entrance of water at the hinges. The present invention provides an improvement over my earlier invention by providing a covered container having the same operational features and advantages, but which is less expensive to manufacture.

BRIEF SUMMARY OF THE INVENTION

The present invention is directed to covers for such containers, and the combinations of such covers and containers, the cover being of homogeneous material configured as portions integrally connected for hinging relative movement, without the use of pivot pins and without having interstices to which water could pass. The covers are made of a plastic material which is stiff enough for retaining shape and function when in place on a container, yet are flexible enough to permit hinging in special hinge areas, and flexible enough to avoid damage due to bumping, etc. in the ordinary course of use of the containers.

According to one aspect of the invention, a hinge portion is formed between two portions of the cover, the hinge portion consisting of a plurality of parallel alternating ridges and grooves, generally describing a saw tooth cross-sectional configuration. However, the grooves and ridges do not extend to the outer circumference of the cover, but instead terminate, preferably with smooth rounded end portions of the ridges and grooves, to a non-ridged preferably flat portion that extends to the circumferential edge of the cover.

According to another aspect of the invention, the parallel grooves and ridges are not symmetric in cross-section, but have widened or thickened portions at their bases and apexes to avoid stress concentration and material failure.

According to another aspect of the invention, particularly adapted for use in covers for very large containers in which the cover is formed in three portions separated by integral hinges with the center portion spanning essentially the full circumference of the opening, a support insert conforming to the shape of the center section is provided for fastening to the center section for supporting and stiffening it.

BRIEF DESCRIPTION OF THE DRAWING

In the drawing, in which like reference numerals indicate corresponding throughout the several views.

FIG. 9 is a fragmentary sectional view to a larger scale taken generally along the line 9—9 of FIG. 7;

FIG. 10 is a sectional view taken along the line 10—10 of FIG. 7, showing the cover partly open; and FIG. 11 is a fragmentary view in perspective of a support liner used in conjunction with the embodiment of FIG. 7.

DESCRIPTION OF THE PREFERRED EMBODIMENTS

Figure 1:
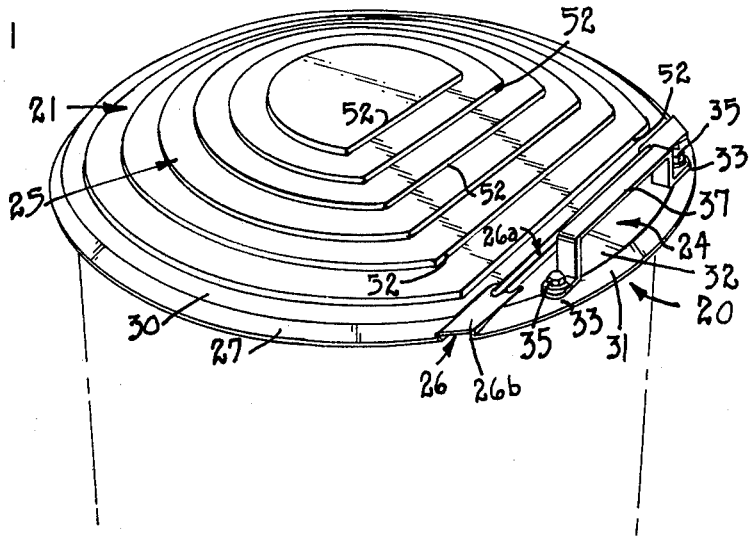
FIG. 1 is a fragmentary view in perspective of a first embodiment of the invention.
Figure 2:
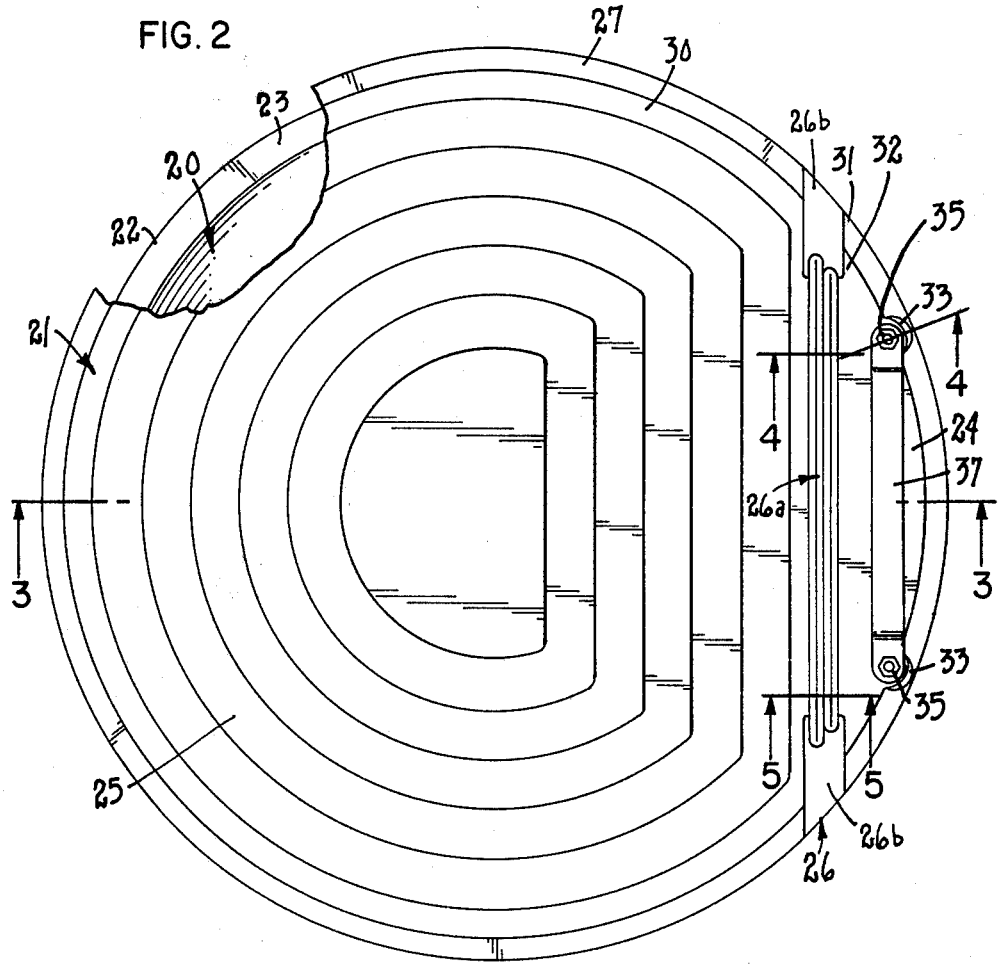
FIG. 2 is a plan view of the structure shown in FIG. 1, with a portion being broken away for clarity of presentation.
Figure 3:
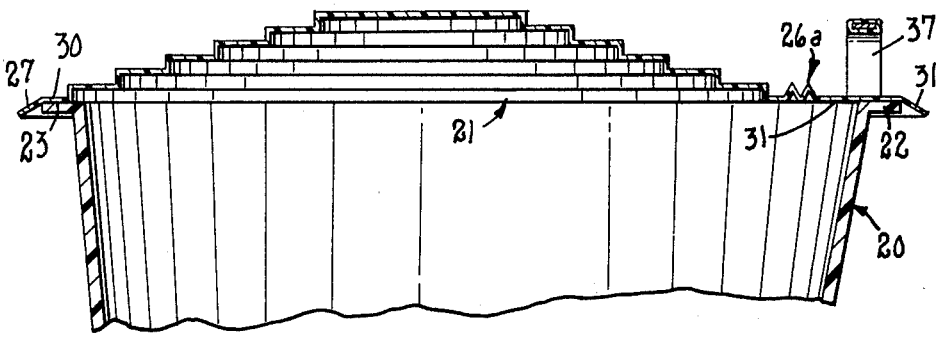
FIG. 3 is a sectional view taken along the line 3—3 of FIG. 2.

In FIG. 1, there is shown a container 20 having a cover 21 according to the invention. Container 20 is of small to medium size and is suitable for use with the cover 21 which is formed of two portions connected by one integral hinge portion. Container 20 is circular in cross-section, but tapered or connically tapered to assist in nesting containers for storage or shipment, and has a flat closed bottom (not shown) and a flange 22 around its top having a flat upper surface 23. The first smaller portion of cover 21 is indicated by reference number 24, and a second larger portion is indicated by reference number 25, and they are connected together by integral hinging interconnection 26. Portion 25 is domed in step-wise fashion to increase its strength, rigidity and rain-shedding ability. The doming steps for the cover are not circular, but are in part defined by linear portions 52 parallel to the ridges of the interconnecting hinge. Portion 25 is surrounded by a bevel 27 at its edge, also for shedding rain, and it has a flat rim 30 for engaging and resting on surface 23 of flange 22 of the container. Portion 24 has a bevel 31 in continuation of bevel 26, and a flat surface 32 which is extended outward slightly at two sites to provide a pair of bosses 33 having bores 34 to pass a pair of mounting bolts 35 which also pass through bores 36 and flange 22 to secure the cover to the container. A coated handle 37 of inverted U-shape is secured by bolts 35 and nuts 38 to assist in manipulating the container when its contents are to be collected and removed.

Integral interconnection hinge 26 includes central portion **26*a* comprising a plurality of generally parallel ridges and grooves, and generally flat end portions 26b at either end of portion 26a**.

Central portion 26a is configured as a plurality of generally plane strips 40, 41, 42, 43 (FIG. 4) intersecting flat portions 30 and 32 at vertices 44 and 45, and mutually intersecting at vertices 46, 47 and 50 to form ridge and groove portions. These vertices and ridges are straight and parallel so that a section taken across the intersection is of a generally saw tooth configuration. However, certain of the vertices are preferably thickened as discussed below. The number of strips may vary, and they can be configured with the ridges generally above the plane of surfaces 30, 31, or below it. At the ends of the ridges, generally where central portion 26a transition to end portions 26a, the strips 40, 41 and the strips 42, 43 are rounded into each other in a cone-like surface which arcs around the end of the ridge like portion.

End portions 26b start as flattened portions extending on either side of the rounded off ends of the ridges of central hinge portion 26a. End portions 26b then extend outwardly in a generally flat manner to the outer periphery, and short generally vertical wedge sections extend to it from the downwardly sloping bevel portions 30 and 31. Flat hinge portions 26b thus cut across and separate bevel portions 30, 31.

Figure 4:
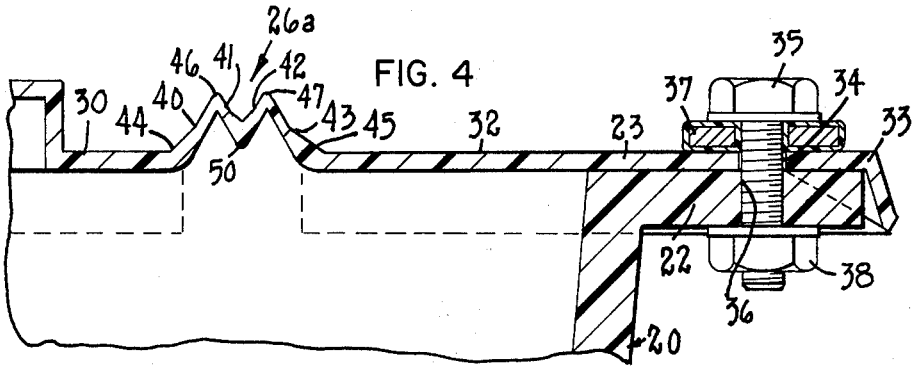
FIGS. 4 and 5 are fragmentary sectional views to a larger scale taken along the lines 4—4 and 5—5 of FIG. 2 in different position of the parts.
Figure 5:
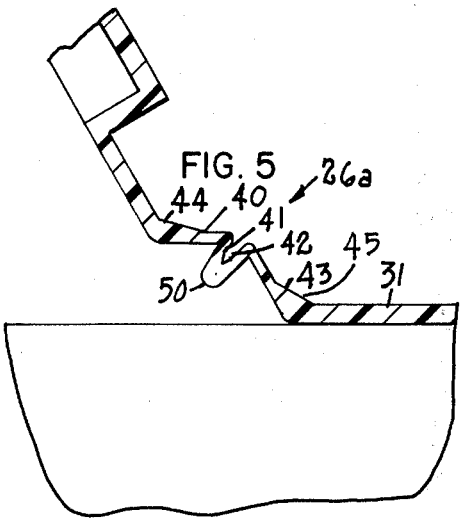

The operation of this embodiment of the invention is illustrated in FIGS. 4 and 5, with the normal, or closed, position of the cover shown in FIG. 4. When it is desired to place materials into the container, the cover is lifted from an outer edge remote from the integral hinge 26 to the opened position indicated in FIG. 5. The hinge mechanism bends or flexes, with the angles at some or all of vertices 44, 45 and 50 becoming smaller and the angles at vertices 46 and 47 becoming greater. In this manner, the flexibility of the material used for the cover is used to advantage to provide a single, homogeneous integral plastic cover without perforations or other openings that would allow water to run in, and yet will allow for opening and closing of the cover. The entire cover is injection molded from rubber-modified polypropylene, for example that made by Ren Thermoplastics, under the name REN-FLEX, although other materials will work also.

It will be appreciated that since the majority of the flexing for the opening of the cover takes place at the vertices, there will be higher stress concentration in those zones. This stress is distributed along the width of the ridges, and preferably over a number of ridges rather than a single hinge line, and the ridges are terminated smoothly with the rounding of one surface around to the other prior to the edge of the cover. The bending at the edge of the cover is accomplished by a gentle, distributed arcing of the normally flat portions 26b, which are bent upward as the cover is opened, and which return to a generally flat shape when the cover is closed. If the ridges of hinge section 26a were run to the edge of the cover, stress concentrations would be formed where the vertices from the parallel grooves and ridges would intersect the edge of the cover, which would be much higher than the stress concentrations which are distributed along the length of the grooves and ridges. Eventually, this could lead to the beginning of rips or tears where vertices would intersect the edge, and once started, such tears could easily propagate along the length of the ridge or groove through subsequent opening and closing operations, until eventually the usefulness of the cover is seriously impaired in terms of allowing leakage or until the tearing becomes so great that the cover separates. The termination of the ridge and groove portions short of the periphery of the cover, the smooth rounding termination of the grooves and ridges, and the use of the generally flat outer hinge portions 26b intersecting the periphery, all help to prevent such unwanted stress concentration and rips or tears.

To further guard against the possibility of tears or separations along the integral hinge central portion 26a, it has been found desirable to provide thickening of the cover at some or all of the vertices. With reference to FIG. 4, vertices 44, 45 and 50 are thickened by sloping and filling in a zone of material on the inside of the angle, when seen in cross-section. This thickening provides additional material in the zones of flexing as the hinge is used, and also counteracts a tendency of a molding process to sometimes cause a thinner structure at corners and edges.

The structure described above is adequate for tops for containers from large to medium size, but when very large containers are needed, for example, those in the 300 gallon size class, a modified structure of the invention which is shown in FIGS. 6–11 is preferred.

In this embodiment a container 101 has an upper flange 102, and a cover 103 comprising a central portion 104 connected by integral hinging interconnections 105 and 106 to a pair of side portions 107 and 110. The portions are provided with bevels 111 around the outer periphery of the cover and with flat surfaces 112 to engage and rest upon flange 102 of the container.

Figure 8:
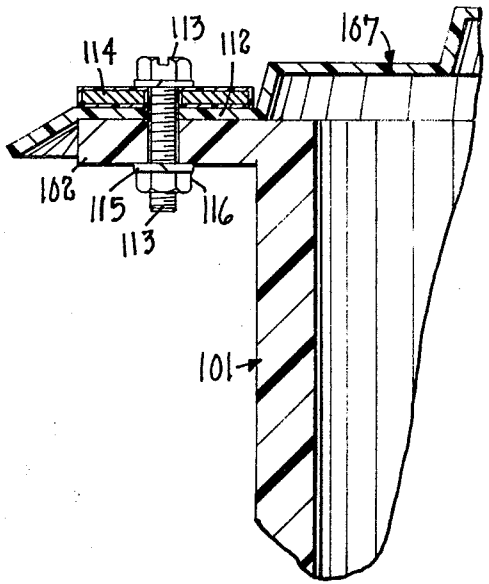
FIG. 8 is a fragmentary sectional view to a larger scale taken along the line 8—8 of FIG. 7.
Figure 7:
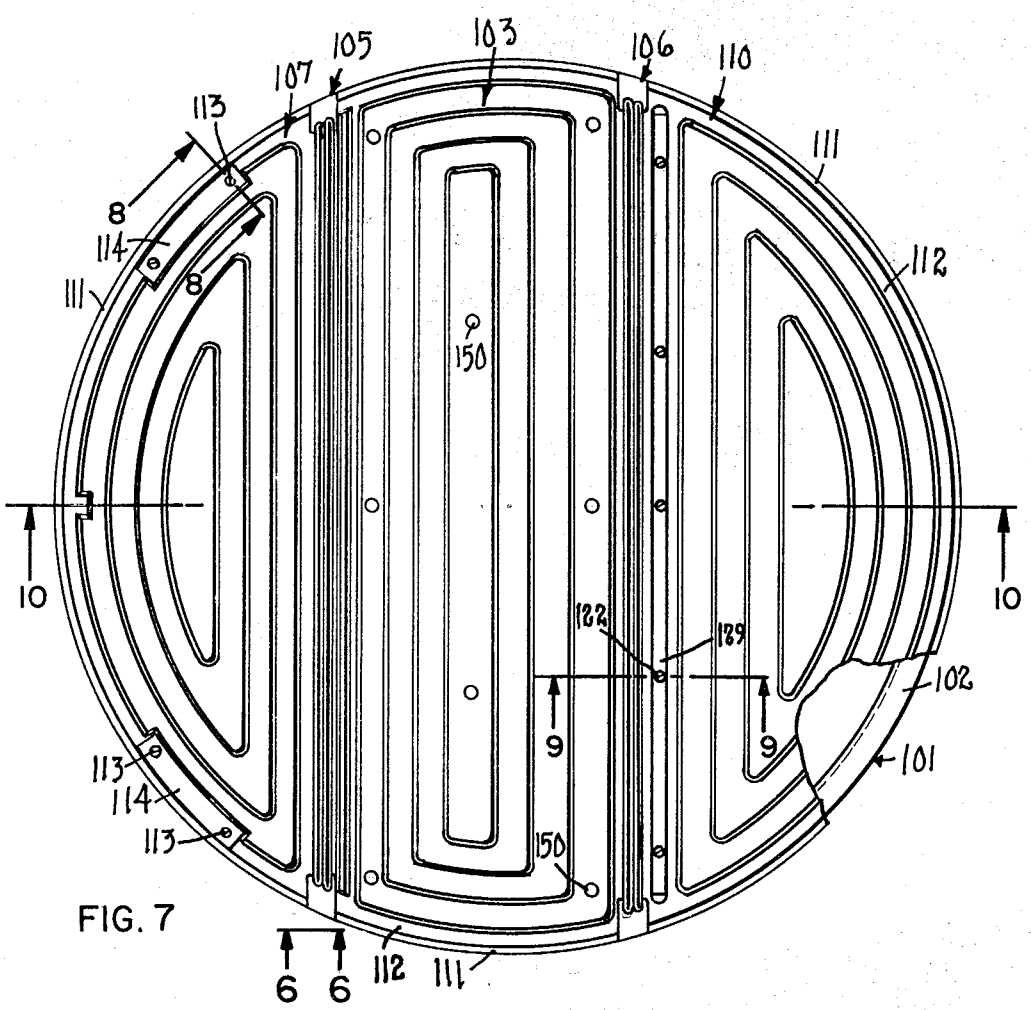
FIG. 7 is a plan view of a second embodiment of the invention.

Side portion 107 is secured to flange 102 by bolts 113 passing through coated clamping plates 114, then through flat surface 112 of portion 107 and through flange 102 to washers 115 and nuts 116 below the flange, as seen in FIG. 8.

Figure 6:
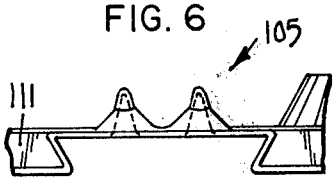
FIG. 6 is a fragmentary view in elevation seen along the line 6—6 of FIG. 7.

The large embodiment uses the same type of integral hinging interconnections 105 and 106 previously discussed with respect to interconnection 26 of the smaller embodiment. These include generally flat end portions extending to and across the beveled outer periphery of the cover, and a plurality of parallel ridges and grooves extending almost the full width of the cover, from one end portion to the other. The rounded off ends of the parallel ridges and grooves are seen in FIG. 6, as are the wedge shaped portions which interconnect from the flat portion of hinge 105 to the peripheral bevel 111.

With reference to FIG. 10, when only small objects are to be placed in the container, only portion 110 of the cover need be lifted, which is accomplished by hinging interconnection 106. For insertion of larger objects, or for emptying the entire container, central portion 104 and also side portion 110 may be lifted.

For a container of such great diameter, the stepwise doming and the cover portions may not be sufficient to prevent sagging and to provide enough rigidity for protection against snow, physical abuse and the like. One method of providing additional reinforcing is the inclusion of reinforcing means 117 as shown in FIG. 9. An upwardly extending, downwardly opening recess 120 is formed in portion 110 and extends generally across the portion to receive a reinforcing member 121, which may be a protectively coated flat strip of iron or an inverted channel iron. Bolts 122 having nuts 123 and washers 124 inside the cover pass through holes in the reinforcing member, through the root of recess 120, and washers from outside, or if desired, a second continuous coated reinforcing strip 129 which may be applied under the heads of the bolts instead of discrete washers.

Another method of reinforcement for the large covers may be use of a stiffening insert, such as shown in FIGS. 10 and 11 for central section 103. It will be appreciated that while side sections 107 and 110 are supported around a significant portion of their periphery by the circumferential flange 102 of the top of the container, central section 104 must span the entire width of the container opening, which in some cases may be as much as 5 feet. The somewhat flexible material for the cover may sag over that distance.

According to one aspect of the invention, the additional rigidity which may be needed for central section 104 is provided by an insert 140 as seen in cross-section in FIG. 10, and one end of which is seen in FIG. 11. Insert 140 is preferably made of a stiffer material, such as ABS plastic or foamed polyethylene. It is configured with a generally flat flange portion 141, and a plurality of step portions 143 leading up to a central step portion 144. A beveled or sloped in portion 145 is provided at each end. Alternatively, steps can be provided in portion 145. The shape is selected to permit insert 140 to conform to and nest within the inner surface of section 104 as seen in FIG. 10. A plurality of hole 142 are provided around the edge portion 141 and also in the top portion 144 of insert 140, and corresponding holes 150 are provided in center section 104 of the cover, to permit securing the insert to the cover, which may be done by suitable rivots or bolt and nut assemblies.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size and arrangement of parts, within the principle of the invention.

What is claimed is:

1. A homogeneous container cover of stiff but flexible material comprising a first portion, a second portion and an interconnecting portion integral with said first and second portions for enabling hinging relative motion therebetween, said interconnecting portion being configured as one or more parallel ridges and grooves formed in said cover forming a generally saw tooth configuration, said ridges and grooves extending across said cover, but stopping short of the peripheral edge of said cover, and a pair of hinge areas free of said ridges and grooves extending from the termination thereof to the outer periphery of the cover.

2. A cover according to claim 1 wherein said ridge and groove portion terminate with round or cone portions that connect between opposite sides of the ridges.

3. A cover according to claim 1 wherein said first and second portions of said cover include bevel portions around the periphery of the cover, and wherein said portions of said interconnecting portion extending from the termination of said ridges and grooves to the periphery of the cover extend across and separate said bevel portions.

4. A cover according to claim 3 wherein said portion crossing and separating said bevel portions are generally flat and including wedge shaped sections connecting therefrom to said bevel portions.

5. A cover according to claim 1 wherein vertices of said ridges and grooves are of thicker material, to prevent stress concentrations and tearing at the vertices.

6. A cover according to claim 5 wherein the back or inside portion of said thickened vertices is formed by a pair of angles and a ramp-like strip between them, to form the thickened vertex area.

7. A cover according to claim 1 in which at least one of said first and second cover portions is step-wise domed upwardly, portions of the steps of said doming being linear in a direction parallel to the vertices of said ridges and grooves.

8. In combination with the cover according to claim 1, a container having an open top surrounded by a mounting flange having a flat upper surface, and means securing one of said first and second cover portions to said upper surface so that said cover hingely closes said opened top.

9. A cover according to claim 1 in which one of said first and second cover portions comprises a pair of sections joined by a further integral hinging interconnection.

10. A cover for a container of flexible material comprising a plurality of sections joined with an integral hinge portion that permits hinging movements therebetween, said hinging portion comprising a plurality of parallel ridges and grooves forming said material extending across the cover and terminating short of the periphery thereof and transitioning to non-ridged hinge portions which extend to the periphery of the cover, said cover configured for covering the open top of a container and being supported thereby around its periphery when in the closed position, at least one of said cover portions having a step-wise dome configuration for increasing rigidity and an insert of stiffer material than said integral cover configured to conform to a surface of said section, and means attaching it thereto to increase the rigidity of said section.

11. A cover according to claim 10 wherein said cover comprises three sections interconnected by a pair of said hinging portions, one of said cover portion for securing to a flange around the opening of the container, and the other two portions for alternately hinging to an open position or to a close position in which the periphery of said portions are supported by resting on the container walls, and wherein said stiffening member is attached to the center section of said cover.

* * * * *

UNITED STATES PATENT AND TRADEMARK OFFICE

CERTIFICATE OF CORRECTION

PATENT NO. : 4,407,427

DATED : October 4, 1983

INVENTOR(S) : Edward J. Reuter

It is certified that error appears in the above-identified patent and that said Letters Patent is hereby corrected as shown below:

Column 1, line 6, after "relates" insert --to--.

Column 2, line 42, "connically" should be --conically--.

Column 3, line 15, "transition" should be --transitions--.

Column 3, line 15, "26a" (2nd occurrence) should be --26b--.

Column 6, line 35, "forming" should be --formed in--.

Signed and Sealed this

*Twenty-eighth* Day of *February 1984*

[SEAL]

*Attest:*

GERALD J. MOSSINGHOFF

*Attesting Officer*

*Commissioner of Patents and Trademarks*